United States Patent [19]

Strohmeyer, Jr.

[11] 4,454,838

[45] Jun. 19, 1984

[54] STEAM GENERATOR HAVING A CIRCULATING FLUIDIZED BED AND A DENSE PACK HEAT EXCHANGER FOR COOLING THE RECIRCULATED SOLID MATERIALS

[75] Inventor: Charles Strohmeyer, Jr., Gladwyne, Pa.

[73] Assignee: Electrodyne Research Corporation, Gladwyne, Pa.

[21] Appl. No.: 477,920

[22] Filed: Mar. 23, 1983

Related U.S. Application Data

[63] Continuation-in-part of Ser. No. 473,651, Mar. 7, 1983.

[51] Int. Cl.[3] ..... F22B 1/00

[52] U.S. Cl. ..... 122/4D; 110/245; 110/263; 431/170

[58] Field of Search ..... 122/4 D; 110/245, 263; 431/7, 170; 165/104.16

[56] References Cited

U.S. PATENT DOCUMENTS 4,145,818 3/1979 Külling ..... 34/57 A
4,250,839 2/1981 Daman ..... 110/263
4,311,670 1/1982 Nieminen et al. ..... 34/57 A
4,336,769 6/1982 Daman ..... 122/4 D

FOREIGN PATENT DOCUMENTS 68708 6/1981 Japan ..... 431/7

*Primary Examiner*—Edward G. Favors
*Assistant Examiner*—Steven E. Warner
*Attorney, Agent, or Firm*—William J. Ruano

[57] ABSTRACT

The invention comprises a dense pack heat exchanger for a steam generator having a circulating fluidized bed combustion system whereby a bed of solid particles comprising fuel and inert material is entrained in the furnace gas stream. Means are provided for collecting high temperature bed solid particles downstream of the furnace. The dense pack heat exchanger directs the hot collected particles down over heat transfer surface, such surface being a portion of the steam generator fluid circuits. Flow is induced by gravity means. The dense compaction of the solid particles around the fluid heat exchange circuits results in high heat transfer rates as the fluid cools the compacted solid material. The heat exchange surface is arranged to facilitate flow of the solid particles through the heat exchanger.

3 Claims, 1 Drawing Figure

Figure 1:
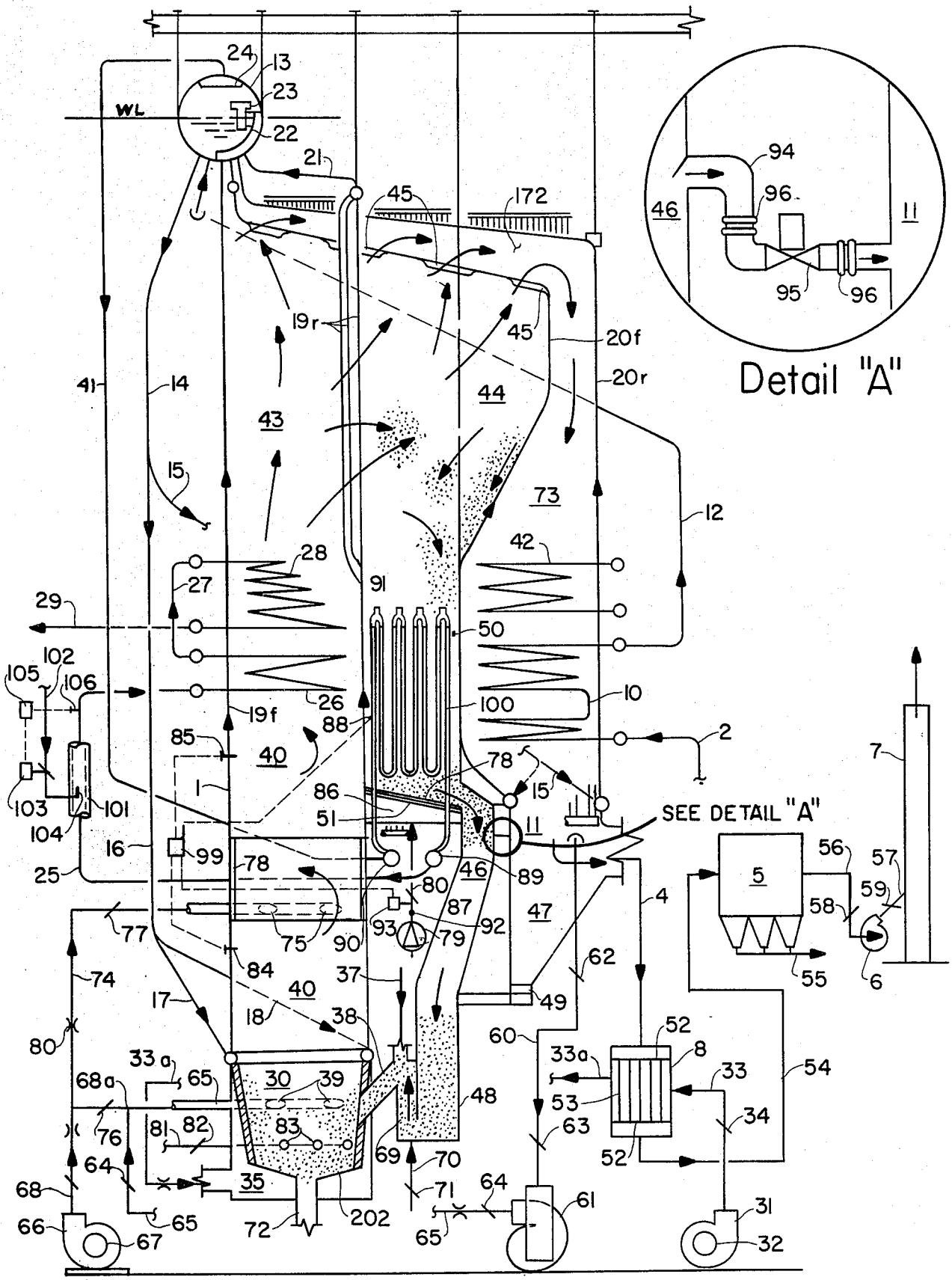

STEAM GENERATOR HAVING A CIRCULATING FLUIDIZED BED AND A DENSE PACK HEAT EXCHANGER FOR COOLING THE RECIRCULATED SOLID MATERIALS

This invention is a continuation-in-part to U.S. patent application Ser. No. 473,651 filed Mar. 9, 1983.

This invention relates to means for improving the performance of steam generators having fluidized bed combustion systems.

The temperature of a circulating bed is maintained substantially below that of a convential firing system (1500° to 1800° F. vs 2500° to 3000° F.). In order to hold the circulating bed temperature in a range as say 1550° F., some means of cooling is required. Air, gas and heat exchange surface provide such cooling means. The inert material in the bed acts as a flywheel and maintains temperature uniform throughout the length of the circulating bed. The mass of the inert material is many times greater than that of the fuel. Heat is extracted from the combustion circuit by the heat exchange surface in contact with the gas and solid inert particles.

In many fluidized beds the temperature of the inert material is held at a constant level. No serious attempt is made to specifically cool the inert material in a regenerative manner. If the inert material can be cooled after it is separated from the gas at the end of the circulation loop, it will then need to be raised in temperature at the head end of the circulating bed after reinjection as it mixes with available fuel and air flow. The inert material will then have a greater cooling effect upon the combustion process and a lesser amount of inert material would need to be recirculated for stabilizing combustion temperature in the recirculating loop.

Extraction of heat from the inert material increases the amount of high level heat transfer which is available. This would be most effective for steam generators having high pressure/temperature primary steam conditions and a reheater.

Prior art includes cooling of the inert material in a fixed fluidized bed before reinjection into the circulating bed. The material is fluidized to bring the inert material into contact with the heat exchanger surface. A large cross sectional area is required for the heat exchanger and intermingling of the air and gas streams among the various parts of the system introduces considerable complexity both in the design and operation of the unit. In effect two boiler circulation systems are integrated with a single boiler drum and firing system.

The present invention overcomes such difficulties in that the dense pack heat exchanger is incorporated into the basic structure of a conventional steam generator. The solid particles, after collection, flow down over the fluid circuit heat exchange surface. The containment for the heat exchanger is a hopper for receiving separated solid inert material. The inert material falls into the hopper and compacts around the fluid circuits. The compact material has fluidity to the same extent that coal and ash will flow from a silo.

The heat exchange surface is projected up from the bottom of the hopper in bayonet fashion. This allows particles of fine solids to settle down around the tubular circuits without obstruction.

The bottom of the hopper is sloped and has a support plate upon which fluidizing air distribution plates are located. This allows a buildup of solids above the floor. Admitting fluidizing air at a controlled rate regulates the amount of inert material that slides off the sloped hopper bottom into a discharge conduit for return to the fluidized bed combustor and furnace for recycle.

The fluidized air admitted through the hopper floor for the control of the flow of solids away from the dense pack heat exchanger does not flow up through the hopper. It can be relieved through means incorporated in the heat exchanger discharge conduit.

The present invention assigns a classic regenerative function to the inert material carried along in the recirculating bed in that the inert material picks up heat from the combustion process inhibiting rise in combustion temperature and carries that heat for direct transfer to the fluid circuits in the dense pack heat exchanger without significant dilution by fluidizing air flow. The total amount of high level heat transfer is substantially increased with minimum upset to the unitized combustion cycle.

For the steam generator described herein, a specific object of this invention is to improve the high temperature heat transfer to fluid capability of a steam generator having a circulating fluidized bed combustion system by means of regenerative transfer of heat from the combustion means to the steam generator fluid circuits utilizing the circulating fluidized bed inert solid particle material as the heat conveying means, such transfer from the inert material to the fluid circuits taking place apart from the combustion means supply air and gas systems.

A further object is, in conjunction with a circulating fluidized bed combustion system, to provide an inert material to steam generator fluid circuit dense pack heat exchanger installed downstream of the point where the inert material has separated from the circulating bed gas stream, the dense pack designation indicating a compact disposition for the inert material as it flows by gravity down around the fluid circuits which are disposed within the heat exchanger.

A still further object is to provide a dense pack heat exchanger enclosure which forms a hopper to receive solid particles separated from the gas stream at the outlet end of the steam generator circulating fluidized bed combustion system.

A still further object is to provide a dense pack heat exchanger enclosure which is integrated with the water cooled gas enclosure system for the steam generator combustion gas system.

A still further object is to provide a dense pack heat exchanger wherein the fluid circuits are disposed in a bayonet type configuration to provide minimum resistance to the downward flow of solid particles from the gas stream to the heat exchanger hopper, the collected solid particles flowing axially and parallelly along the tube lengths.

A still further object is to provide a dense pack heat exchanger wherein a floor is provided to support the inert solid particles as they flow into the hopper to build up the level of particles surrounding the heat exchanger tubular fluid circuits.

A still further object is to provide a means to overflow solid particles from the bottom/outlet end of the heat exchanger, the overflow passing through conduit means to means for returning the effluent solid particles to the steam generator combustion system for recycle in the circulating fluidized bed.

A still further object is to provide a means for regulating the rate of solid particle overflow as by use of gas fluidizing means and whereby the fluidizing gas escapes downstream of the heat exchanger since it is not involved in the heat transfer function of the heat exchanger.

The invention will be described in detail with reference to the accompanying drawing wherein:

FIG. 1 is a schematic diagram of a steam generator having a circulating type fluidized bed and a dense pack heat exchanger in accordance with the objectives of the invention.

On FIG. 1, steam generator 1 is of a conventional design with regard to the fluid circuits. Feedwater at the working pressure enters the unit through conduit 2 which feeds to economizer 10.

Effluent from economizer 10 passes through conduit 12 to drum 13 from whence it passes through conduits 14, 15, 16, 17 and 18 to lower waterwall headers which supply the furnace and convection pass waterwalls 19*f*, 19*r*, 20*f* and 20*r*. The waterwalls, including sidewalls, are of the membrane type. Waterwalls 19*f*, 20*f*, and 20*r* discharge to drum 13. The rear furnace wall 19*r* is connected to drum 13 through conduit 21.

Baffle 22 within drum 13 directs the steam and water mixture to separators 23. Separated water exits from the bottom of separator 23 and joins with the feedwater from conduit 12 and is recirculated downward through conduit 14. Separated steam passes through the top of separators 23 through baffles and up through outlet screens 24 to conduit 41.

Steam from drum 13 is drawn through conduit 41 to the inlet header of tubular heat exchange surface 100. Steam exits from the outlet header of surface 100 through conduit 25 to desuperheater 101 and intermediate superheater 26, from whence it passes through conduit 27 to final superheater 28 and out through conduit 29 to a steam consumer (not shown).

Water level WL in drum 13 is maintained at a fixed set point by control of feedwater flow through conduit 2 (not shown).

Combustor 30 is of the fluidized type wherein particles of fuel and inert material disperse themselves throughout the bed.

F. D. fan 31 takes air from atmosphere through inlet vanes 32 which control air flow. F. D. fan 31 discharges through duct 33 and shutoff damper 34 (for isolation purposes) to air heater 8. The hot gas then passes through duct 33*a* to plenum chamber 35.

Plenum chamber 35 feeds air to combustor 30 through sized holes in the floor 202 of combustor 30.

Primary fuels, as coal, are fed to combustor 30 through conduit 37. Where $SO_2$ removal is required, limestone is injected with the fuel through conduit 37. Secondary fuels as trash and waste products may enter combustor 30 along with the primary fuel through conduits 37 and 38.

Ignition begins in the lower portion of combustor 30 and as the particles of fuel and inert material rise in the fluidized bed through displacement by fuel, limestone and inert material which are added through conduit 38, reach the level at which ports 39 are located. Ports 39 supply secondary gas flow which generates gas velocity at this point sufficiently high to entrain desired quantities of bed solids in the gas stream, carrying such solids upward into furnace 40.

Supplemental air fan 66 takes air from atmosphere through inlet vanes 67 and discharges through duct 68 and 68*a* to duct 65 and ports 39 or alternatively, through duct 68 to duct 74 and ports 75. Ports 75 supply tertiary air to the upper portion of the furnace 40 for elevating gas temperature at the outlet of furnace 40.

An air heater for heating supplemental air could be provided similar to the case of F. D. fan 31. Such air heater could be in series or parallel with air heater 8 on the gas side. In parallel it would receive gas from duct 4 and discharge to duct 54. In series, such an air heater could be inserted in either duct 4 or duct 54. Supplemental air fan discharge duct 68 would feed to and discharge from the air heater equivalent to ducts 33 and 33*a*, all upstream of the juncture of duct 68 with ducts 68*a* and 74.

Gas from plenum 11 is drawn through conduit 60 to gas recirculation fan 61. Dampers 62 and 64 are for isolation purposes. Damper 63 is for flow control. Gas recirculation fan 61 discharges through duct 65 to secondary gas ports 39.

Dampers 76 and 77 proportion supplemental air flow to secondary gas ports 39 or tertiary air ports 75 respectively. Inlet vanes 67 control supplemental air flow.

The furnace walls in the vicinity of the tertiary air ports 75 may be studded and lined with refractory 78 to accelerate combustion in the area of refractory 78 and assist in the elevation of gas temperature at the outlet of furnace 40.

Ports 75 assist in raising the level of furnace 40 gas outlet temperature to a level as 1800° F. to increase heat transfer in the downstream surface 26, 28, 42 and 10 while maintaining gas temperature in the combustor 30 and adjacent area at a level as 1550° F.

Fuel is added to combustor 30 through conduit 38 and at this point it is mixed thoroughly throughout the bed.

Air is admitted to the combustor through sized holes in the floor 202 from plenum 35. This flow is only a portion of the total air flow required for combustion purposes. Additional air flow is added through secondary ports 39 and tertiary ports 75.

Air flow through the various points of entry (202, 39 and 75) regulates combustion rates in the associated furnace zones and can be used for control of bed temperatures in these zones.

To accomodate variations in air flow between ports 39 and 75 and to insure adaquate entrainment gas velocity above ports 39, gas is recirculated from plenum 11 through fan 61 to conduit 65 and through ports 39 to combustor 30.

Gas temperature above ports 39 is measured by thermocouple 84 and temperature above ports 75 is measured by thermocouple 85.

There is a gas velocity increase after the gas enters surface 26 and 28 in series as it leaves furnace 40. As heat is transferred from the gas to the surface 26 and 28 tubes, gas temperature decreases. This reduces the specific volume of the gas as well as gas velocity for a given cross sectional area of the gas path.

The volumetric relationship within plenums 43 and 44 is such to permit the gas velocity to drop below entrainment level at the outlet of platens 28 to permit settlement of the fuel and inert material particles which fall downward into hopper 50. Particles collected in hopper 50 flow down around tubular surface 100.

Gas passes from plenum 43 to plenum 44 through rear furnace wall tubes 19*r* at which point the membrane is lacking and alternating tubes have been spread sufficiently to permit passage of gas.

The tube configuration of surface 28 is such to assist in distribution of gas flow to plenums 43 and 44.

Gas flows upward to the top of plenums 43 and 44 where it exits through ports 45.

Ports 45 are located in the roof plane 20*f* and are formed by upsetting individual tubes for specific lengths from the plane of the tube and membrane sheet. Where the welded in membranes are of sufficient width, slots 45 can be formed by the omission of the membranes in specified locations.

Ports 45 are spaced and sized to create uniform gas distribution up through plenums 43 and 44. The overall configuration is such to avoid turbulance in the gas flow as the gas passes from tube bank 28 through plenums 43 and 44 to ports 45.

Duct 172 is formed by the continuation of walls 20*f* and 20*r*, with a space between, over plenums 43 and 44. The walls 20*f* and 20*r* are of the membrane type wherein metal strips are welded in place between parallel tube circuits to make a gas tight enclosure.

Gas from plenum 73 flows through surface 42 and 10 to plenum 11. Surface 42 can be reheating surface or an extension of or an alternative for superheating or economizer surface.

Solid particles collected in plenum 11 fall to hopper 47. Rotary feeder 49 is power driven and feeds dust from hopper 47 to bin 48 and is provided with a displacement type of seal to prevent reverse flow.

Gas from plenum 11 passes through duct 4 to air heater 8.

Air heater 8 is provided with tube sheets 52 in which tubes 53 are mounted. The gas from duct 4 passes through tubes 53 to duct 54. F. D. fan 31 discharge air flow passes around tubes 53. Gas duct 54 passes to bag house 5 where dust collection is completed. Dust separated in the bags is removed through conduits 55.

Bag house 5 discharges through duct 56 to I. D. fan 6 and duct 57 to stack 7 and from thence to atmosphere. Dampers 58 and 59 are for isolation purposes and to regulate flow of gas so as to maintain a slightly negative pressure in furnace 40.

Solid particles collected in bin 48 pass through loop seal 69. Dust flow through loop seal 69 is facilitated by means of an air lift. Air under pressure enters through conduit 70 and flow is controlled by regulation means 71 which is power operated.

According to the present invention, solid particles collected in plenums 43 and 44 fall downward by gravity into hopper 50, where tubular heat exchange surface 100 is located. The walls of hopper 50 are formed by water cooled furnace wall 19*r*, rear gas pass waterwall 20*f* and associated water cooled sidewalls.

Floor 51 of hopper 50 is sloped downward in the direction of flow which is toward discharge conduit 46. Air distribution plates 78 are mounted on top of floor 51. Floor 51 is provided with holes (not shown) uniformly spaced over the surface on about three inch centers to supply air to air distribution plates 78.

Blower 79 takes air from atmosphere and pressurizes it. The pressurized air discharges through conduit 80 to plenum 86 where it is distributed by the holes in floor 51 to distribution plates 78 mounted above floor 51.

Distribution plates 78 are porous and the flow of air up through them permeates the mass of solid inert particles immediately above floor 51, fluidizing the solid particles to the point of permitting them to slide down floor 51 incline and dump into discharge conduit 46 from whence they feed to bin 48, air lift 69 and conduit 38 for recycle in combustor 30.

Tubular heat exchange surface 100 is arranged in multiple parallel platens, each connected to common inlet and outlet headers 89 and 90. It is anticipated that the platens would be spaced on centers of approximately 8 inches or as otherwise required for the duty intended. The platens extend in a transverse direction into the plane of the FIG. 1 drawing. The individual platen 100 configuration, illustrated on FIG. 1, shows that the reverse bends 91 at the top of the platen are close coupled. The tubes connecting to the reverse bends have a close center to center dimension. Forged reverse bends of such a type are commercially available. The tip of the forgings have a nose which minimizes resistance for the solid particles as they drop into hopper 50. The reverse bend forging and close coupled tubes form a bayonet like structure leaving clearance around such projections for free movement of the collected solid particles of inert material as they fall down through hopper 50 on their way to discharge conduit 46.

The reverse bends at the bottom end of platens 100 are of an expanded radius to allow ample spacing between the upright bayonet like tubular projections.

Plenum 86 may be segmented in the direction transverse to the plane of FIG. 1 drawing to serve individual portions of platens 100 by way of controlling air distribution to the individual plenum 86 segments. In such case, blower 79 discharge conduit forms a distribution manifold at point 92. Air to the individual segments would be controlled by flow control means 87, one of which would be located in the feed conduit 80 to each plenum 86 segment.

Blower 79 is provided with relief means (not shown) to permit discharge air flow from the blower to vary as a consequence of the throttling action of control means 87.

Modulation of flow control means 87 permits regulation of the rate at which inert material particles spill over from hopper 50 to discharge conduit 46. Flow control means incorporates power actuated means 93 which is responsive to load demand controller 99. Controller 99 is responsive to unit loading and temperatures as measured by thermocouples 84 and 85 as well as level in hopper 50 as measured at point 88.

It is not intended that fluidizing air from blower 79 through air distribution plates 78 pass up through hopper 50, thereby fluidizing the inert material around tubular platens 100. The fluidizing air from blower 79 passes with the solid particles to discharge conduit 46 where it can be discharged to plenum 11 as shown on FIG. 1, Detail "A". Bypass conduit 94 connects discharge conduit 46 to plenum 11. Back pressure valve 95 is set for a low differential pressure to eliminate unnecessary heat escape from conduit 46. Expansion joints 96 permit movement between the equipment pieces.

Substantial heat is transferred to tubular fluid conduits 100 from the hot particles of solid inert material passing through hopper 50. A high level heat source is employed to achieve this objective. As the cooled solid particles are returned to combustor 30 for recycle, they must be reheated. This requires an increase in firing rate which can be accomplished without raising the temperature of the bed above set point.

The net effect of the regenerative heating function of the recirculated inert material particles is to assign more high temperature heat transfer duty to heating of the steam generator fluid circuits and more lower temperature heat transfer duty for air heating. The former is concentrated in the circulating bed loop and the latter at the tail end portion of the gas path after solids have been separated from the stream for recirculation.

The recirculation loop of the circulating fluidized bed combustion system can be described as follows: The combustor 30 contains bubbling bed below ports 39. The lower bed overflows above the secondary gas ports 39 by addition of fuel, limestone and recirculated solid particles through conduit 38. Gas flow through gas ports 39 lifts the bed materials up into furnace 40 as a result of maintaining furnace gas velocity in the entrainment range. Solid particles are collected in hopper 50 as gas velocity in plenums 43 and 44 drops below entrainment value. Hopper 50 material passes through the dense pack heat exchanger flowing over platen 100 bayonet type elements. Solids from the heat exchanger are discharged into conduit 46 which connects to bin 48 below. From bin 48, solid particles pass through loop seal and air lift 69 to conduit 38 and back to combustor 30 for recycle.

Ash can be removed from the circulating loop through the opening at the bottom of combustor 30 through conduit 72. Ash is removed on a continuous basis to maintain equilibruium in the combustion system.

Oil or gas can be admitted through conduit 81, flow control means 82 and nozzles 83 into combustor 30 for firing during unit startup or for use as a supplemental or emergency fuel during times when the design fuel supply has been interrupted. Nozzles 83 are equipped with ignition means.

The capability to retain the hot inert material within hopper 50 for some period of time provides a stabilizing effect with respect to continuity of heat transfer rate from the bed of inert material to the fluid circuits 100. For the case illustrated, means are shown to enable a balance to be maintained between superheating and steam generating duty.

The same source that supplies high pressure feedwater to conduit 2 also feeds the equivalent supply to conduit 102, flow controller 103 and spray nozzle 104 for steam desuperheating service in desuperheater 101. Flow controller 103 is power actuated and is responsive to temperature controller 105 which senses steam temperature downstream of desuperheater 101 through connection to thermocouple 106. As steam temperature at 106 increases above set point in controller 105, controller 105 opens flow controller 103 admitting more water flow through spray nozzle 104 and vice versa.

If heat pickup in circuits 100 is excessive, the steam temperature is reduced by means of spray water injection. The reverse is also true. Spray water injection has a certain equivalency to steam generation as the quantity of steam flow is increased or decreased correspondingly downstream of the desuperheater. Thus, spray water increase or decrease provides a means for striking a balance between steam generating and superheating duties for the integrated operation of the unit.

The type of duty assigned to platens 100 is not a specific part of this invention. The platens may be all of one class with respect to type of duty as primary superheating, intermediate superheating, reheating, steam generating, or feedwater heating. Alternatively, the platens may comprise combinations of various duties. The circuitry would be modified accordingly and is a standard procedure for one knowledgeable in the art. In the case of evaporating and feedwater heating duty a different configuration for platens 100 would be required.

Platens 100 can be arranged horizontally to accomplish the same basic objective. In such case, the inlet and outlet headers could be located to accomodate tube projections through the hopper 50 sidewalls. These walls are parallel to the plane of FIG. 1 drawing.

The essence of the invention is the association of the hot recirculated solid particle material in dense pack disposition with the steam generator tubular fluid heat transfer circuits. The arrangement of the fluid circuits is so disposed to permit the collected solids to pass freely over the fluid circuits, the collected solids by themselves having the equivalency of a fluid level by virtue of their form.

Thus it will be seen that I have provided an efficient embodiment of my invention whereby a regenerative heat transfer system is employed in a steam generating apparatus to transfer heat from the combustion gases to steam generator fluid circuits which are external to the gas path, utilizing solid inert particles after circulation in the combustion portion of a circulating fluidized bed as the heat conveying medium; the inert particles after separation from the gas stream, collect in a hopper and flow down around the fluid circuits by gravity means, at which time heat flows from the inert particles to the fluid circuits; the hopper for receiving the inert particles has been incorporated into the water cooled wall structure of the steam generator; the fluid circuits are shown arranged in bayonet fashion, projecting up from the floor of the hopper to minimize resistance as the inert particles drop down among the fluid circuits; the hopper floor permits retention of the inert material in the hopper to the desired degree; the hopper bottom is provided with means for flowing the inert particles away from the hopper outlet by gravity to a discharge conduit for return of the inert particles to the combustion portion of the circulating fluidized bed loop; control mean are provided for controlling the rate at which the inert particles discharge from the hopper.

While I have illustrated and described several embodiments of my invention, these are by way of illustration only and various changes and modifications may be made within the contemplation of my invention and within the scope of the following claims:

I claim:

1. An apparatus for high level transfer of heat between recirculated solids and fluid cooled heat absorption circuits in a steam generator which comprises:

means defining a steam generator with combustion system in which the high level transfer of said heat is carried out;

a feedwater inlet and superheated steam outlet and fluid cooled heat absorption circuits in between;

means for combustion of a solid fuel in a vertical reactor in association with cooled inert solid particles;

first inlet means for air located in the bottom part of said reactor for fluidizing said solid fuel and inert particles;

second inlet means for secondary gas located at a level above said first inlet means and to entrain a substantial portion of said solid fuel and inert particles in the flue gas stream produced by said means for combustion, said solid fuel, said inert particles and said first and said second inlet means;

third inlet means for air located at a level above said second inlet means for regulating continued combustion of particles of said solid fuel;

a superheated portion of said heat absorption circuits disposed above the outlet of said vertical reactor;

means for separation of particles of solid materials in said flue gas stream downstream of said superheated portion;

indirect heat exchange means receiving said particles separated from said flue gas stream and to transfer heat to another portion of said heat absorption circuits thereby cooling said separated particles substantially;

means for recycling said cooled separated particles as substantially inert material to said means for combustion and for association with said solid fuel;

means for removing ash from the recirculating loop of solids on a continuing basis maintaining equilibrium of solids in said combustion means;

means for controlling rate of discharge of said cooled separated particles from said indirect heat exchange means in response to flue gas temperature upstream and downstream of said third inlet means;

said means for combustion reheating said cooled inert solid particles, said reheating suppressing temperature of the mixture in said flue gas stream;

said means for controlling rate of discharge of said cooled separated particles to providing the amount of said solid material recirculated for maintaining combustion temperature in said downstream zone of said reactor at a level as 1800° F. and in said upstream zone of said reactor at a level as 1550° F. with provision for variation of temperature differential.

2. An apparatus as described in claim 1 and which additionally comprises:

means for delivery of air to said second inlet means including a fan or blower and wherein at least a portion of said secondary gas comprises air.

3. An apparatus as described in claim 2 and which additionally comprises:

means for delivery of cooled flue gas after separation of said particles to said second inlet means including a fan or blower and wherein at least a portion of said secondary gas comprises recirculated cooled flue gas.

* * * * *